US008695183B2

(12) United States Patent
Kent

(10) Patent No.: US 8,695,183 B2
(45) Date of Patent: Apr. 15, 2014

(54) EARRING BACKING

(76) Inventor: Melecy M. Kent, Los Angeles, CA (US)

( * ) Notice: Subject to any disclaimer, the term of this patent is extended or adjusted under 35 U.S.C. 154(b) by 297 days.

(21) Appl. No.: 11/779,822

(22) Filed: Jul. 18, 2007

(65) Prior Publication Data

US 2009/0019891 A1 Jan. 22, 2009

(51) Int. Cl.
*A44C 7/00* (2006.01)

(52) U.S. Cl.
USPC ..... 24/705

(58) Field of Classification Search
None
See application file for complete search history.

(56) References Cited

U.S. PATENT DOCUMENTS 570,838 A * 11/1896 Bolton ..... 24/707.6
1,139,264 A * 5/1915 Gage ..... 24/707.2
3,563,056 A * 2/1971 Noel ..... 63/12
4,694,664 A * 9/1987 Elsener ..... 63/12
5,170,542 A * 12/1992 Greenberg ..... 24/705
5,816,073 A * 10/1998 Bardisbanyan ..... 63/12
2005/0092022 A1 * 5/2005 Umehara ..... 63/35

FOREIGN PATENT DOCUMENTS

| | | |
|---|---|---|
| EP | 1224885 | 7/2002 |
| FR | 2768904 | 4/1999 |
| JP | 2006218245 | 8/2006 |
| WO | WO 92/21262 | 12/1992 |

OTHER PUBLICATIONS

PCT International Search Report dated Aug. 6, 2008, mailed Aug. 18, 2008, 11 pgs.

* cited by examiner

*Primary Examiner* — Jack W. Lavinder
(74) *Attorney, Agent, or Firm* — K&L Gates LLP

(57) ABSTRACT

An earring backing that retains the earring frontispiece with an upward tilt. A contact plate that resides in contact with the back of the earlobe of a user is coupled to a support structure that defines a channel for an earring post. The channel defines an acute angle with the contact plate.

14 Claims, 3 Drawing Sheets

EARRING BACKING

BACKGROUND

1. Field of Invention

Embodiments of the invention relate to earring backings. More specifically, embodiments of the invention relate to earrings having a frontispiece which would benefit in appearance by having upward tilt when worn.

2. Background

Historically, earrings have adorned pierced ears on a world-wide basis for several thousand years. Typically, the basic pierced earring includes a decorative frontispiece secured to a thin post which passes through a small opening in the earlobe and then into a clasping device at the back surface of the lobe. Thus, the frontispiece and the face of the backing are parallel and at right angles to the earring post.

This configuration is simple and generally satisfactory in terms of the visual display of the frontispiece; however, when the frontispiece is somewhat large and heavy and/or the wearer's earlobes are not firm, there is a marked propensity for drooping and impairment of the visual appearance.

BRIEF DESCRIPTION OF THE DRAWINGS

The invention is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

DETAILED DESCRIPTION

Figure 1:
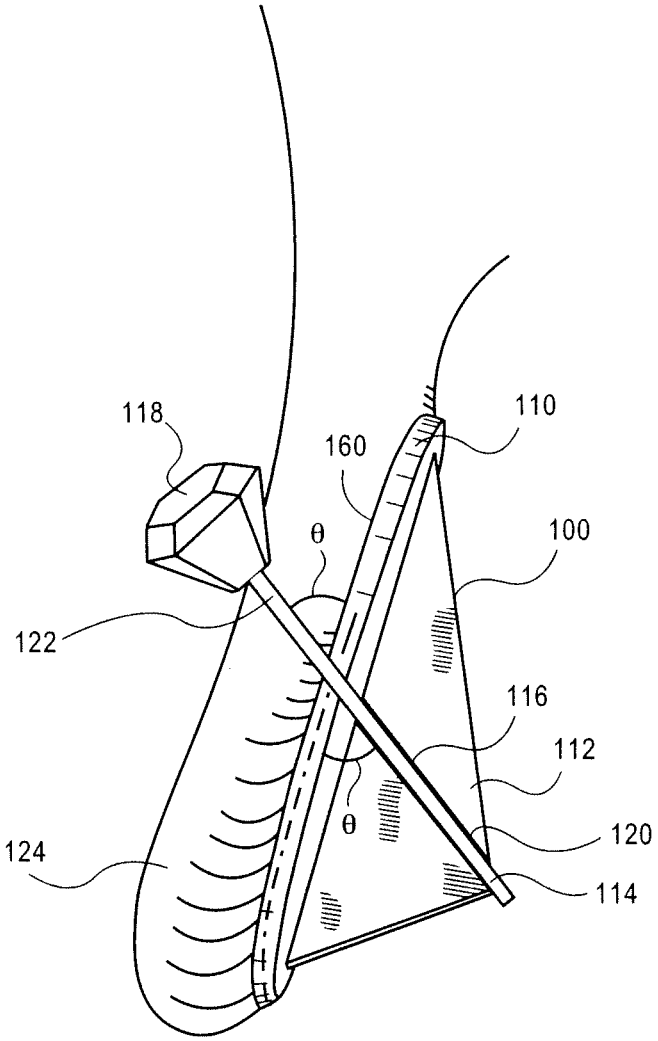
FIG. 1 is a cutaway perspective view of an earring backing of one embodiment of the invention in use.

FIG. 1 is a cutaway perspective view of an earring backing of one embodiment of the invention in use. An earring having a frontispiece 118 and a post 122 that passes through an earlobe 124 engages an earring backing 100. Earring backing 100 includes a contact plate 110 having the contact surface 160 to be in contact with the earlobe 124 during use. A support structure 112 is coupled to contact plate 110. In this embodiment, support structure 112 defines an internal channel 120 into which earring post 122 may be inserted and retained.

Channel 120 is defined to form an acute angle θ with the contact plate. Thus, when post 22 resides within channel 120, the post forms a corresponding acute angle θ with contact surface 160 of contact plate 110. Acute angle θ will commonly be less than 75° and more commonly in the range of 30° to 70°. In a preferred embodiment, the angle θ will be in the range of 35° to 45°. In conjunction with the upward pressure applied on the back of the earlobe by the contact plate as a result of the natural leverage of the angularly retained post with the angle at which the post is retained causes the earlobe to tilt up slightly and frontispiece 118 to be tilted upward thereby enhancing the appearance of the frontispiece 118. The smaller the angle θ the greater the upward tilt of frontispiece 118.

In some embodiments, channel 120 may include a liner 116 of friction enhancing material, such as various elastomers or Teflon. The liner 116 increases the friction between post 122 and earring backing 100 to improve retention of the earring. The liner 116 may be of differing thickness and softness in different embodiments to accommodate differences among earring posts. In some embodiments, channel 120 tapers to its distal end 114 thereby increasing friction and retention of the earring post 122 within the channel.

In one embodiment, contact plate 110 may be formed of metal or high density plastic and support structure may be formed of an elastomeric material that defines channel 120. As used herein, the term "distal" refers to the portion of the earring backing furthest from the earlobe during use and the term "proximal" refers to the side or end of the earring backing closest to the earlobe during use. In still other embodiments, the distal opening 114 may be provided with a lip (not shown) to elastically engage a groove (not shown) in the earring post 122.

Figure 2:
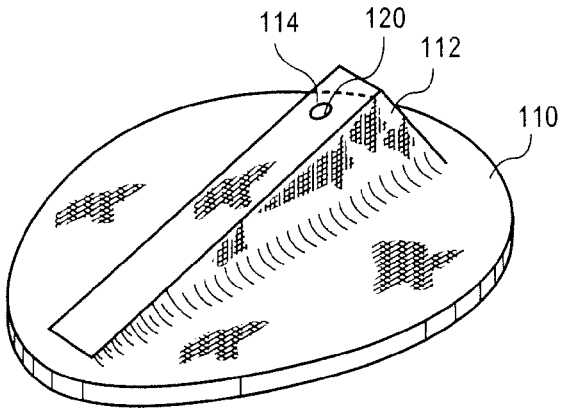
FIG. 2 is a perspective view of the back side of the earring backing of one embodiment of the invention.

FIG. 2 is a perspective view of a back side of the earring backing of one embodiment of the invention. In this embodiment, earring backing includes a contact plate 110 and support structure 112 coupled to the contact plate. Support structure 112 defines a channel having a distal end 114, the channel to permit passage of an earring post through the earring backing.

In some embodiments, support structure 112 may be integrally formed out of the same material as contact plate 110. Suitable materials include, but are not limited to, metallic materials such as, silver, gold and other precious metals, stainless steel or other suitable non-corrosive metals, and high density plastics. In some embodiments, an earring backing may be cast or molded, while other embodiments it may be machined. In some embodiments, the support structure 112 may be of a different material than support structure 110. In some embodiments, separately manufactured support structure 112 may be adhered to contact plate 110 with adhesive, solder, heat welding or a similar manner of attachment.

Figure 3:
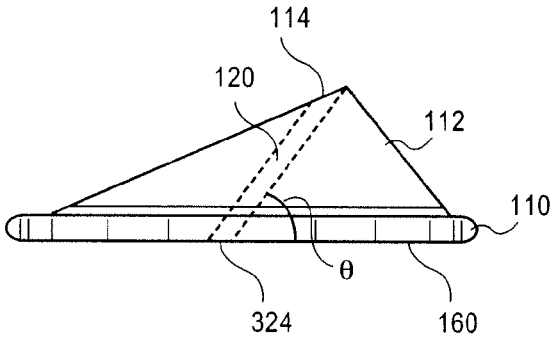
FIG. 3 is a horizontally oriented side view of an earring backing of one embodiment the invention.

FIG. 3 is a horizontally oriented side view of an earring backing of one embodiment of the invention. Channel 120, which forms acute angle θ, on contact plate 110, is shown in phantom lines. In this embodiment, channel 120 has proximal opening 324 in the contact surface 160 of contact plate 110 and a distal opening 114 at the distal end of contact structure 112. In other embodiments, channel 120 may not pass completely through support structure 112, such that no distal opening 114 will be present. Channel 120 need not be cylindrical. In some embodiments, channel 120 may be, for example, triangular or rectangular in cross section to accommodate triangular or rectangular earring posts. Other shapes are also envisioned as being within the scope and contemplation of embodiments the invention. Similarly, while support structure 112 is shown as being substantially triangular, it is within the scope and contemplation of the invention that other shapes of support structures may be employed. In fact, the support structure need not be solid, it merely needs to have sufficient material and structural rigidity to define the angular channel and retain the earring post at the desired angle θ as explained above with reference to FIG. 1.

Figure 4:
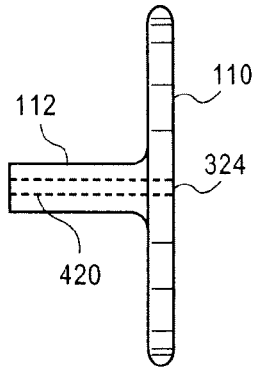
FIG. 4 is a plan top view of an earring backing of one embodiment the invention.

FIG. 4 is a plan top view of an earring backing of one embodiment of the invention. In this example, channel 420 does not penetrate support structure 112. Thus, channel 420 has only one opening, proximal opening 324. Such an embodiment is more constrained in the length of earring post it can accommodate. In other embodiments, the support structure may define more than one channel, each channel at a different acute angle relative to the contact plate. In such an embodiment, the contact plate may define more than one proximal opening.

Figure 5:
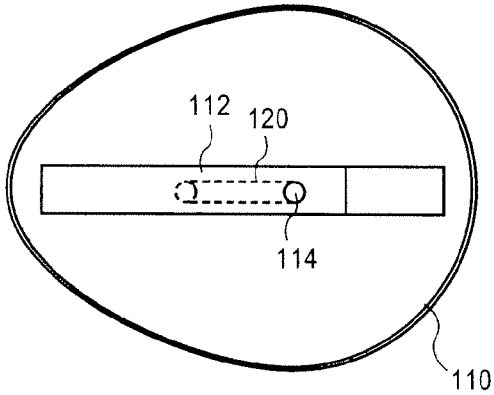
FIG. 5 is a plan view of a back side of an earring backing of one embodiment of the invention.

FIG. 5 is a plan view of a back side of an earring backing of one embodiment of the invention. In this view, distal opening 114 of channel 120 (shown in phantom lines) can be seen.

Figure 6:
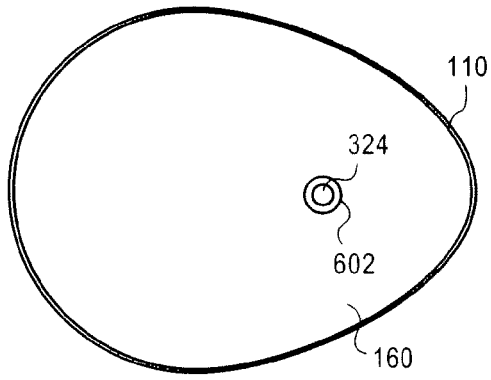
FIG. 6 is a plan view of a contact surface of an earring backing of one embodiment the invention.

FIG. 6 is a plan view of a contact surface of an earring backing of one embodiment of the invention. Contact surface 160 of contact plate 110 may be substantially planar. Proximal opening 324 of channel 120 (not shown) may be surrounded by a collar 602. Collar 602 is preferably made of hypoallergenic metal, such as gold, steel or the like to eliminate risk of infection to the wearer. In some embodiments, where, for example, the entire contact surface 160 may be made of a hypoallergenic material and the collar 602 per se may be omitted. Collar 602 is preferably substantially flush with contact surface 160. In some embodiments, collar 602 is electroplated to contact surface 160. In other embodiments, collar 602 is adhered or otherwise retained in a recess defined by contact plate 120 around proximal opening 324.

Figure 7:
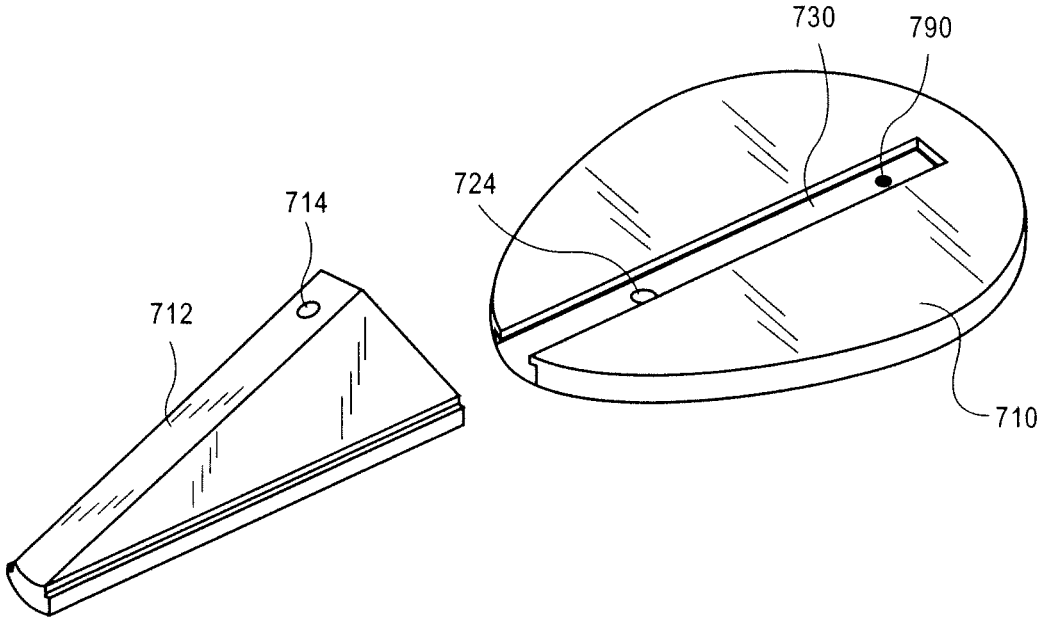
FIG. 7 is a perspective view of an alternative embodiment of the invention.

FIG. 7 is a perspective view of an alternative embodiment of the invention. In such an embodiment, contact plate 710 defines a track 730 into which an attachable support structure 712 may be removably engaged. A detent 790 may retain the support structure 712 at a proper location such that channel 714 corresponds with proximal opening 724.

Other mechanisms for detachably coupling a support structure defines angular channel to a contact plate are also envisioned to be within the scope and contemplation of other embodiments of the invention. Such a detachable coupling allows a single contact plate to be used with multiple alternative support structures, which may, for example, have channels defining different acute angles with the support structure. This permits a user to select a particular angle that best accentuates a particular earring.

In the foregoing specification, the invention has been described with reference to the specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

The invention claimed is:

1. An apparatus comprising:

an earring backing having a contact surface to contact an earlobe of a user when in use, the backing defining a channel through the contact surface to receive a straight post of an earring, the channel defining an acute angle with the contact surface; and a friction increasing liner disposed within the channel.

2. The apparatus of claim 1, wherein when in use, the contact surface causes the earlobe to tilt upward.

3. The apparatus of claim 1, further comprising an earring having a frontispiece and a straight post, wherein the straight post is structured when in use to extend into the channel of the earring backing.

4. The apparatus of claim 1, wherein the channel tapers at a distal end thereof.

5. The apparatus of claim 1, further comprising a hypoallergenic collar positioned around an opening of the channel formed in the contact surface.

6. The apparatus of claim 1, wherein the contact surface is substantially planar.

7. The apparatus of claim 1, further comprising the channel defining an acute angle with the contact surface of less than 75 degrees.

8. The apparatus of claim 7, further comprising the channel defining an acute angle with the contact surface in the range of 30 degrees to 70 degrees.

9. The apparatus of claim 8, further comprising the channel defining an acute angle with the contact surface in the range of 35 degrees to 45 degrees.

10. The apparatus of claim 1, wherein the friction increasing liner comprises an elastomer.

11. The apparatus of claim 1, wherein the channel through the contact surface comprises a triangular cross section.

12. The apparatus of claim 1, wherein the channel through the contact surface comprises a rectangular cross section.

13. An apparatus comprising:

an earring backing having a contact surface to contact an earlobe of a user when in use, the backing defining a channel through the contact surface to receive a straight post of an earring, the channel defining an acute angle with the contact surface;

an earring having a frontispiece and a post; and wherein the channel tapers at a distal end to increase friction between the channel and the post when the post is inserted into the channel.

14. An earring backing comprising:

a contact plate having a proximal surface to contact and cause an upward tilt of an earlobe of a user when in use;

a support structure coupled to a distal surface of the contact plate and defining a post channel at an acute angle to the proximal surface; and wherein the contact plate comprises a metallic material and the support structure comprises an elastomeric material.

* * * * *

UNITED STATES PATENT AND TRADEMARK OFFICE

CERTIFICATE OF CORRECTION

PATENT NO. : 8,695,183 B2
APPLICATION NO. : 11/779822
DATED : April 15, 2014
INVENTOR(S) : Melecey M. Kent It is certified that error appears in the above-identified patent and that said Letters Patent is hereby corrected as shown below:

Title Page, Item (76) Inventor delete "Melecy" and replace therewith -- Melecey --.

Signed and Sealed this
Nineteenth Day of May, 2015

Michelle K. Lee

Michelle K. Lee
*Director of the United States Patent and Trademark Office*